US009799282B2

(12) United States Patent
Lee et al.

(10) Patent No.: US 9,799,282 B2
(45) Date of Patent: Oct. 24, 2017

(54) LIQUID CRYSTAL DISPLAY DEVICE AND METHOD FOR DRIVING THE SAME

(71) Applicant: Samsung Display Co. Ltd., Yongin (KR)

(72) Inventors: Sang Ik Lee, Seoul (KR); Young Soo Yoon, Seoul (KR); Joon Chul Goh, Hwaseong-si (KR); In Jae Hwang, Suwon-si (KR); Byung Sun Kim, Seoul (KR); Dae Gwang Jang, Cheonan-si (KR); Seok Ha Hong, Yongin-si (KR)

(73) Assignee: SAMSUNG DISPLAY CO. LTD., Gyeonggi-Do (KR)

( * ) Notice: Subject to any disclaimer, the term of this patent is extended or adjusted under 35 U.S.C. 154(b) by 437 days.

(21) Appl. No.: 14/294,918

(22) Filed: Jun. 3, 2014

(65) Prior Publication Data

US 2015/0221273 A1 Aug. 6, 2015

(30) Foreign Application Priority Data

Feb. 5, 2014 (KR) ..... 10-2014-0013131

(51) Int. Cl.
*G09G 3/36* (2006.01)

(52) U.S. Cl.
CPC ..... *G09G 3/3614* (2013.01); *G09G 3/3655* (2013.01); *G09G 3/3677* (2013.01); *G09G 2310/0205* (2013.01); *G09G 2320/0209* (2013.01); *G09G 2320/0219* (2013.01); *G09G 2320/0233* (2013.01)

(58) Field of Classification Search
CPC ..... G09G 3/36
See application file for complete search history.

(56) References Cited

U.S. PATENT DOCUMENTS

| | | | | |
|---|---|---|---|---|
| 6,891,522 | B2 | 5/2005 | Song et al. | |
| 7,551,157 | B2 | 6/2009 | Tanaka et al. | |
| 7,652,648 | B2 | 1/2010 | Takatori et al. | |
| 8,107,027 | B2 | 1/2012 | Kim | |
| 8,330,700 | B2 | 12/2012 | Yamanaka | |
| 2004/0183768 | A1* | 9/2004 | Yamato | G09G 3/3614 345/98 |
| 2008/0238898 | A1* | 10/2008 | Yamanaka | G09G 3/3614 345/204 |
| 2008/0297676 | A1* | 12/2008 | Kimura | G02F 1/13624 349/39 |

FOREIGN PATENT DOCUMENTS

| | | |
|---|---|---|
| JP | 2006-267544 | 10/2006 |
| KR | 1020060041046 | 2/2006 |

* cited by examiner

*Primary Examiner* — Tony N Ngo
(74) *Attorney, Agent, or Firm* — Cantor Colburn LLP

(57) ABSTRACT

A liquid crystal display device includes a plurality of pixels arranged substantially in a matrix form, where a part of the plurality of pixels defines a pixel column block, a first scan signal is simultaneously applied to an n-th row pixel and an (n+2)-th row pixel of the pixel column block, a second scan signal, which is applied prior to the first scan signal, is simultaneously applied to an (n+1)-th row pixel and an (n+3)-th row pixel of the pixel column block, a first data voltage is applied to the n-th row pixel and the (n+1)-th row pixel, a second data voltage having a polarity different from a polarity of the first data voltage is applied to the (n+2)-th row pixel and the (n+3)-th row pixel, and the polarities of the first data voltage and the second data voltage are inverted on a frame-by-frame basis.

25 Claims, 11 Drawing Sheets

LIQUID CRYSTAL DISPLAY DEVICE AND METHOD FOR DRIVING THE SAME

This application claims priority to Korean Patent Application No. 10-2014-0013131, filed on Feb. 5, 2014, and all the benefits accruing therefrom under 35 U.S.C. §119, the content of which in its entirety is herein incorporated by reference.

BACKGROUND

1. Field

Exemplary embodiments of the invention relate to a liquid crystal display device and a method for driving the liquid crystal display device.

2. Description of the Prior Art

A liquid crystal display ("LCD") device has characteristics of relatively small size, light weight and large-scaled screen in comparison to a conventional cathode ray tube ("CRT"), and thus the LCD device has been widely used in recent. The LCD device may display an image using a plurality of unit pixels including thin film transistors and pixel capacitors. The pixel capacitor may include a pixel electrode, a common electrode and liquid crystals provided between the pixel electrode and the common electrode. The LCD device changes an electric field formed between the pixel electrode and the common electrode by providing external charge (i.e., gradation signal) to the pixel electrode through the thin film transistor. The alignment of liquid crystal molecules is controlled by the change of the electric field, and the light transmission through the liquid crystal molecules is thereby controlled to display the image.

The resolution of the LCD device is proportional to the number of unit pixels provided in a unit area. That is, as the number of unit pixels formed in the unit area is increased, the resolution is also increased.

SUMMARY

In a liquid crystal display device, as the resolution is increased, the number of scan lines is increased, and time required to charge the external charge (i.e., data signal) to one pixel electrode is thereby decreased. That is, the liquid crystal display device is unable to perform image expression smoothly, and thus the display quality of the display device may be deteriorated.

In the liquid crystal display device, as the resolution of the liquid crystal display device is increased, the gap distance between neighboring pixels in a column direction is shortened. Accordingly, parasitic capacitance of the pixels may be increased as the resolution of the liquid crystal display device is increased, and a data coupling may occur between the neighboring pixels. Due to such a data coupling, a specific pixel column may have higher luminance or lower luminance than the neighboring pixel column, and thus the corresponding pixel column may be visually recognized as a horizontal line on the display device to deteriorate the display quality of the liquid crystal display device.

Accordingly, exemplary embodiments of the invention provide a liquid crystal display device, in which the data coupling between neighboring pixels is effectively prevented while providing sufficient data charge time to the pixels.

Exemplary embodiments of the invention provide a method for driving a liquid crystal display device, which may effectively prevent the data coupling between neighboring pixels while providing sufficient data charge time to the pixels.

Additional features of exemplary embodiments of the invention will be set forth in part in the description which follows and in part will become apparent to those having ordinary skill in the art upon examination of the following or may be learned from practice of the invention.

In an exemplary embodiment of the invention, a liquid crystal display device includes a plurality of pixels arranged substantially in a matrix form, where a part of the plurality of pixels defines a pixel column block, a first scan signal is simultaneously applied to an n-th row pixel and an (n+2)-th row pixel of the pixel column block, a second scan signal, which is applied prior to the first scan signal, is simultaneously applied to an (n+1)-th row pixel and an (n+3)-th row pixel of the pixel column block, a first data voltage is applied to the n-th row pixel and the (n+1)-th row pixel, a second data voltage having a polarity different from a polarity of the first data voltage is applied to the (n+2)-th row pixel and the (n+3)-th row pixel, and the polarities of the first data voltage and the second data voltage are inverted on a frame-by-frame basis.

In an exemplary embodiment, each of the first scan signal and the second scan signal may include a scan-on signal and a scan-off signal, the n-th row pixel and the (n+2)-th row pixel may respectively receive the first data voltage and the second data voltage in response to the scan-on signal of the first scan signal, and the (n+1)-th row pixel and the (n+3)-th row pixel may respectively receive the first data voltage and the second data voltage in response to the scan-on signal of the second scan signal.

In an exemplary embodiment, the liquid crystal display device may further include a plurality of scan lines which extends substantially in a first direction and is connected to the plurality of pixels, and a plurality of data lines which extends substantially in a second direction, which is perpendicular to the first direction, and is connected to the plurality of pixels.

In an exemplary embodiment, a scan line connected to the n-th row pixel and a scan line connected to the (n+2)-th row pixel, among the plurality of scan lines, may be connected to a first scan connection line to receive the first scan signal, and a scan line connected to the (n+1)-th row pixel and a scan line connected to the (n+3)-th row pixel, among the plurality of scan lines, may be connected to a second scan connection line to receive the second scan signal.

In an exemplary embodiment, each of the plurality of pixels may include a first sub-pixel and a second sub-pixel, and the plurality of scan lines may pass a region between the first sub-pixel and the second sub-pixel in the first direction.

In an exemplary embodiment, the first sub-pixel and the second sub-pixel have different data charge amounts from each other with respect to a same data voltage.

In an exemplary embodiment, the pixel column block may be defined by pixels in a 4×1 matrix form among the plurality of pixels, the first scan signal may be simultaneously applied to a first row pixel and a third row pixel of the pixel column block, the second scan signal may be simultaneously applied to a second row pixel and a fourth row pixel of the pixel column block, the first data voltage may be applied to the first row pixel and the second row pixel of the pixel column block, and the second data voltage may be applied to the third row pixel and the fourth row pixel of the pixel column block.

In an exemplary embodiment, data voltages having different polarities from each other may be applied to neighboring pixels in a row direction.

In an exemplary embodiment, data voltages having a same polarity as each other may be applied to neighboring pixels in a row direction.

In another exemplary embodiment of the invention, a liquid crystal display device includes: a display unit including a plurality of pixels arranged substantially in a matrix form, wherein a pixel column block is defined by a part of the plurality of pixels; a scan driving unit which simultaneously applies a first scan signal to an n-th row pixel and an (n+2)-th row pixel of the pixel column block, and simultaneously applies a second scan signal to an (n+1)-th row pixel and an (n+3)-th row pixel of the pixel column block; and a data driving unit which applies a first data voltage to the n-th row pixel and the (n+1)-th row pixel and applies a second data voltage having a polarity different from a polarity of the first data voltage to the (n+2)-th row pixel and the (n+3)-th row pixel, where the scan driving unit applies the first scan signal after applying the second scan signal, and the polarities of the first data voltage and the second data voltage are inverted on a frame-by-frame basis.

In an exemplary embodiment, each of the first scan signal and the second scan signal may include a scan-on signal and a scan-off signal, the n-th row pixel and the (n+2)-th row pixel may respectively receive the first data voltage and the second data voltage in response to the scan-on signal of the first scan signal, and the (n+1)-th row pixel and the (n+3)-th row pixel may respectively receive the first data voltage and the second data voltage in response to the scan-on signal of the second scan signal.

In an exemplary embodiment, the display unit may further include a plurality of scan lines which extends substantially in a first direction and is connected to the plurality of pixels, and a plurality of data lines which extends substantially in a second direction, which is perpendicular to the first direction, and is connected to the plurality of pixels.

In an exemplary embodiment, the scan driving unit applies the first scan signal and the second scan signal to a first scan connection line and a second scan connection line, respectively, the first scan connection line is connected to a scan line connected to the n-th row pixel and a scan line connected to the (n+2)-th row pixel among the plurality of scan lines, and the second scan connection line is connected to a scan line connected to the (n+1)-th row pixel and a scan line connected to the (n+3)-th row pixel among the plurality of scan lines.

In an exemplary embodiment, the pixel column block may be defined by pixels in a 4×1 matrix form, the first scan signal may be simultaneously applied to a first row pixel and a third row pixel of the pixel column block, the second scan signal may be simultaneously applied to a second row pixel and a fourth row pixel of the pixel column block, the first data voltage may be applied to the first row pixel and the second row pixel of the pixel column block, and the second data voltage may be applied to the third row pixel and the fourth row pixel of the pixel column block.

In an exemplary embodiment, data voltages having different polarities from each other may be applied to neighboring pixels in a row direction.

In an exemplary embodiment, data voltages having a same polarity as each other may be applied to neighboring pixels in a row direction.

In another exemplary embodiment of the invention, a method for driving a liquid crystal display device includes: generating a first data voltage and a second data voltage having different polarities from each other; applying a first data voltage and a second data voltage to an n-th row pixel and an (n+2)-th row pixel of a pixel column block defined in a plurality of pixels of the liquid crystal display device, where the plurality of pixels are arranged substantially in a matrix form; and applying the first data voltage and the second data voltage to an (n+1)-th row pixel and an (n+3)-th row pixel of the pixel column block, where a first scan signal is simultaneously applied to the n-th pixel and the (n+2)-th pixel, a second scan signal, which is applied prior to the first scan signal, is simultaneously applied to the (n+1)-th row pixel and the (n+3)-th row pixel, and the polarities of the first data voltage and the second data voltage are inverted on a frame-by-frame basis.

In an exemplary embodiment, each of the first scan signal and the second scan signal may include a scan-on signal and a scan-off signal, the n-th row pixel and the (n+2)-th row pixel may respectively receive the first data voltage and the second data voltage in response to the scan-on signal of the first scan signal, and the (n+1)-th row pixel and the (n+3)-th row pixel may respectively receive the first data voltage and the second data voltage in response to the scan-on signal of the second scan signal.

In an exemplary embodiment, data voltages having different polarities from each other may be applied to neighboring pixels in a row direction.

In an exemplary embodiment, data voltages having a same polarity as each other may be applied to neighboring pixels in a row direction.

According to exemplary embodiments of the invention, time for charging the data voltage may be effectively increased, and thus the display quality of the liquid crystal display device is substantially improved. In such embodiments, the data voltage coupling between the neighboring pixels may be effectively prevented, and thus the display quality of the liquid crystal display device is substantially improved.

BRIEF DESCRIPTION OF THE DRAWINGS

The above and other features of the invention will be more apparent by describing in further detail exemplary embodiments thereof with reference to the accompanying drawings, in which.

DETAILED DESCRIPTION

Figure 1:
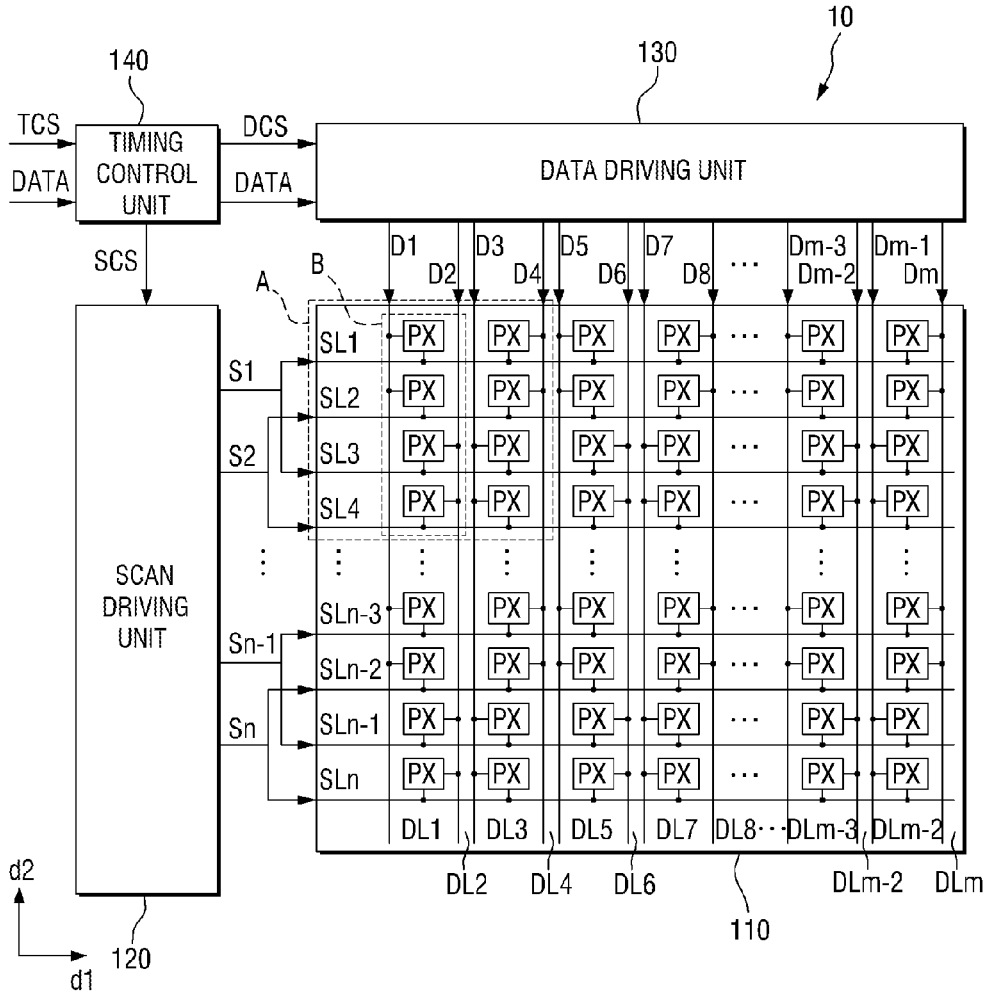
FIG. 1 is a block diagram showing an exemplary embodiment of a liquid crystal display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

FIG. 1 is a block diagram showing an exemplary embodiment of a liquid crystal display device according to the invention.

Referring to FIG. 1, an exemplary embodiment of a liquid crystal display device 10 includes a display unit 110, a scan driving unit 120, a data driving unit 130 and a timing control unit 140.

The display unit 110 may be a region where an image is displayed, e.g., an image display region. The display unit 110 may include a plurality of scan lines SL1 to SLn, a plurality of data lines DL1 to DLm that crosses the plurality of scan lines SL1 to SLn, and a plurality of pixels PX connected to the plurality of scan lines SL1 to SLn and the plurality of data lines DL1 to DLm. In such an embodiment, each of the plurality of pixels PX is connected to a corresponding scan line of the plurality of scan lines SL1 to SLn and a corresponding data line of the plurality of data lines DL1 to DLm. The plurality of scan lines SL1 to SLn may extend substantially in a first direction d1, and may be substantially parallel to each other. The plurality of scan lines SL1 to SLn may include first to n-th scan lines SL1 to SLn. The plurality of data lines DL1 to DLm may cross the plurality of scan lines SL1 to SLn. In such an embodiment, the plurality of data lines DL1 to DLm may extend substantially in a second direction d2 that is perpendicular to the first direction d1, and may be substantially parallel to each other. In an exemplary embodiment, the plurality of pixels PX may be arranged substantially in a matrix form, the first direction d1 may correspond to a pixel row direction, and the second direction d2 may correspond to a pixel column direction. Data voltages D1 to Dm may be applied to the plurality of data lines DL1 to DLm. In such an embodiment, as described above, the plurality of pixels PX may be arranged substantially in a matrix form, but not being limited thereto. The plurality of pixels PX may receive the data voltages D1 to Dm that are applied to the data lines DL1 to DLm in response to scan signals S1 to Sn provided from the scan lines SL1 to SLn.

The timing control unit 140 may receive an input of a timing control signal TCS from an external system, and may generate a scan control signal SCS for controlling the scan driving unit 120 and a data control signal DCS for controlling the data driving unit 130. The timing control signal TCS may include a vertical sync signal, a horizontal sync signal, a data enable signal, and a clock signal. Further, the timing control unit 140 may receive image data DATA from the external system. The timing control unit 140 may align and convert the received image data and may provide the converted image data to the data driving unit 130.

The scan driving unit 120 may receive the scan control signal SCS from the timing control unit 140. The scan driving unit 120 may output and provide the plurality of scan signals S1 to Sn to the display unit 110 based on the received scan control signals SCS. The scan driving unit 120 may output the second scan signal S2 prior to the first scan signal S1. In an exemplary embodiment, the first scan signal S1 may be output after the second signal is output. An exemplary embodiment of the method in which the scan driving unit 120 outputs the scan signal S1 to Sn will be described in detail later.

The data driving unit 130 may include a shift register, a latch and a digital-to-analog converter. The data driving unit 130 may receive the data control signal DCS and the image data DATA from the timing control unit 140. The data driving unit 130 may select a reference voltage based on the data control signal DCS among a plurality of predetermined reference voltages, and may convert the digital image data DATA into the plurality of data voltages D1 to Dm based on the reference voltages. In an exemplary embodiment, the first data voltage D1 and the second data voltage D2 may have different polarities from each other. In such an embodiment, the data voltages that are supplied to neighboring data lines of the display unit 110 may have different polarities from each other. The data voltages will be described later in greater detail.

In an exemplary embodiment, the display unit 110 may include a pixel column block B. In such an embodiment, a part of the plurality of pixels PX, e.g., a predetermined number of pixels sequentially arranged in a same pixel column, may define a pixel column block B. In an exemplary embodiment, the display unit 110 may include a plurality of pixel column blocks B that are repeatedly arranged. The pixel column blocks B may be arranged substantially in a matrix form. The scan signal that is applied to the (n+1)-th row pixel and the (n+3)-th row pixel of the pixel column block B may be applied prior to the scan signal that is applied to the n-th row pixel and the (n+2)-th row pixel of the pixel column block B. In such an embodiment, the polarity of the data voltage that is applied to the n-th row pixel and the (n+1)-th row pixel of the pixel column block B may be different from the polarity of the data voltage that is applied to the n-th row pixel and the (n+2)-th row pixel. Hereinafter, referring to FIG. 2, the pixel column block B will be described in greater detail. The pixel column block B in FIG. 2 may be substantially the same as the remaining pixel column blocks that are repeatedly arranged of the display unit 110.

Figure 2:
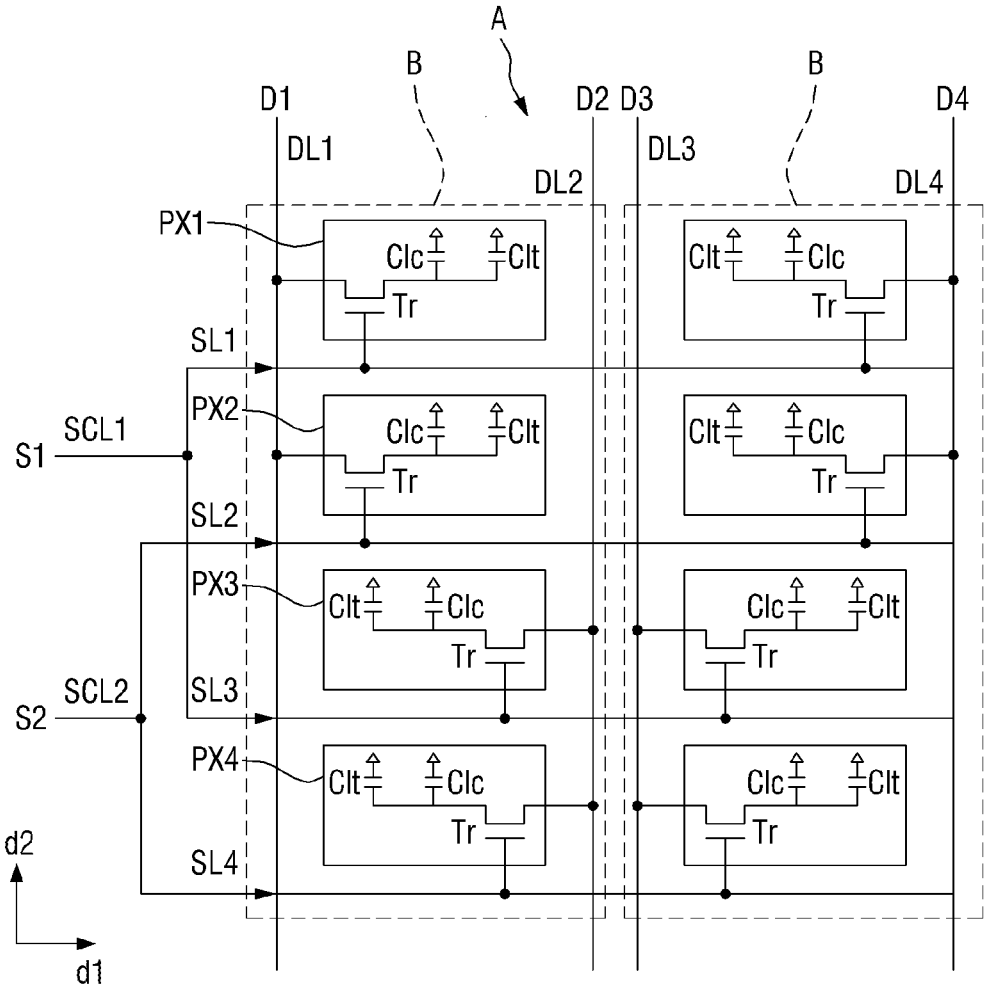
FIG. 2 is an enlarged circuit diagram of an area A in FIG. 1.
Figure 3:
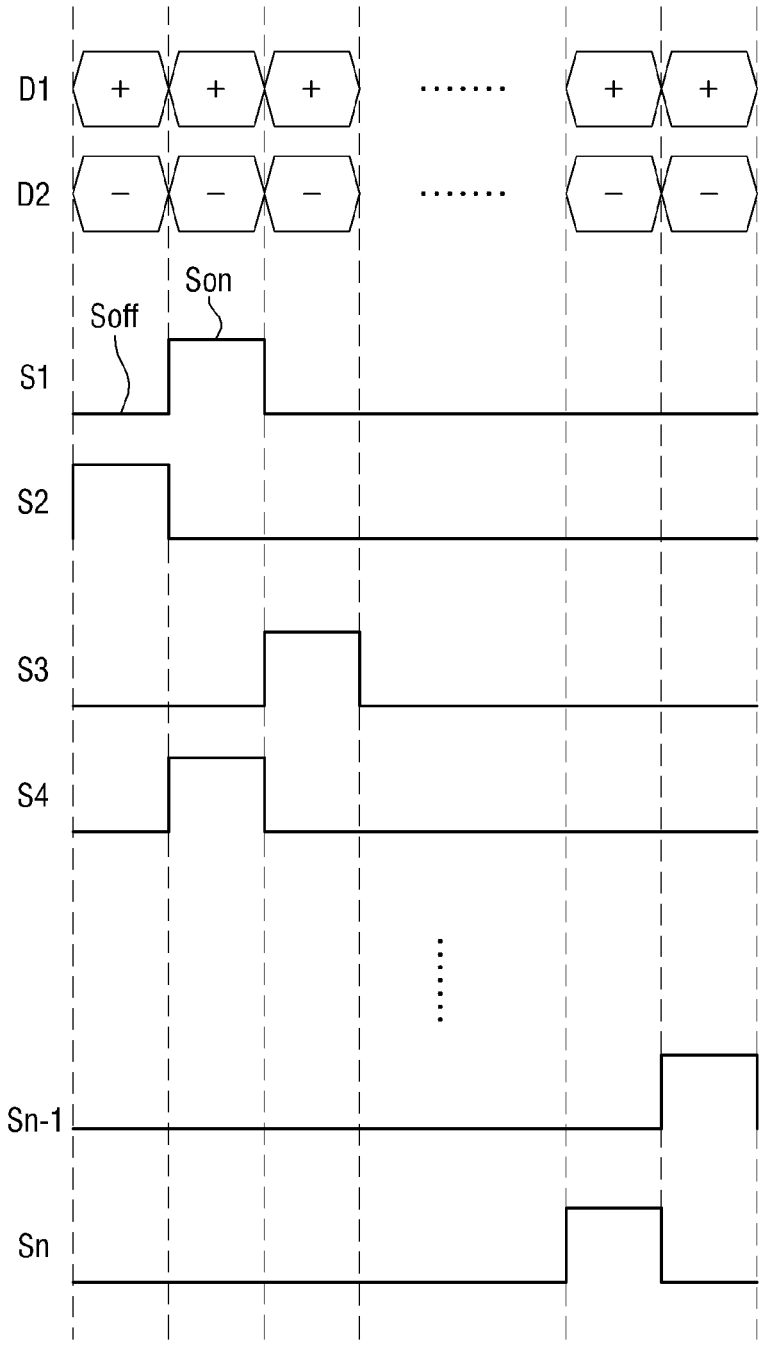
FIG. 3 is a schematic signal timing diagram showing the relationship between a scan signal and a data voltage in an exemplary embodiment of the liquid crystal display device.
Figure 4:
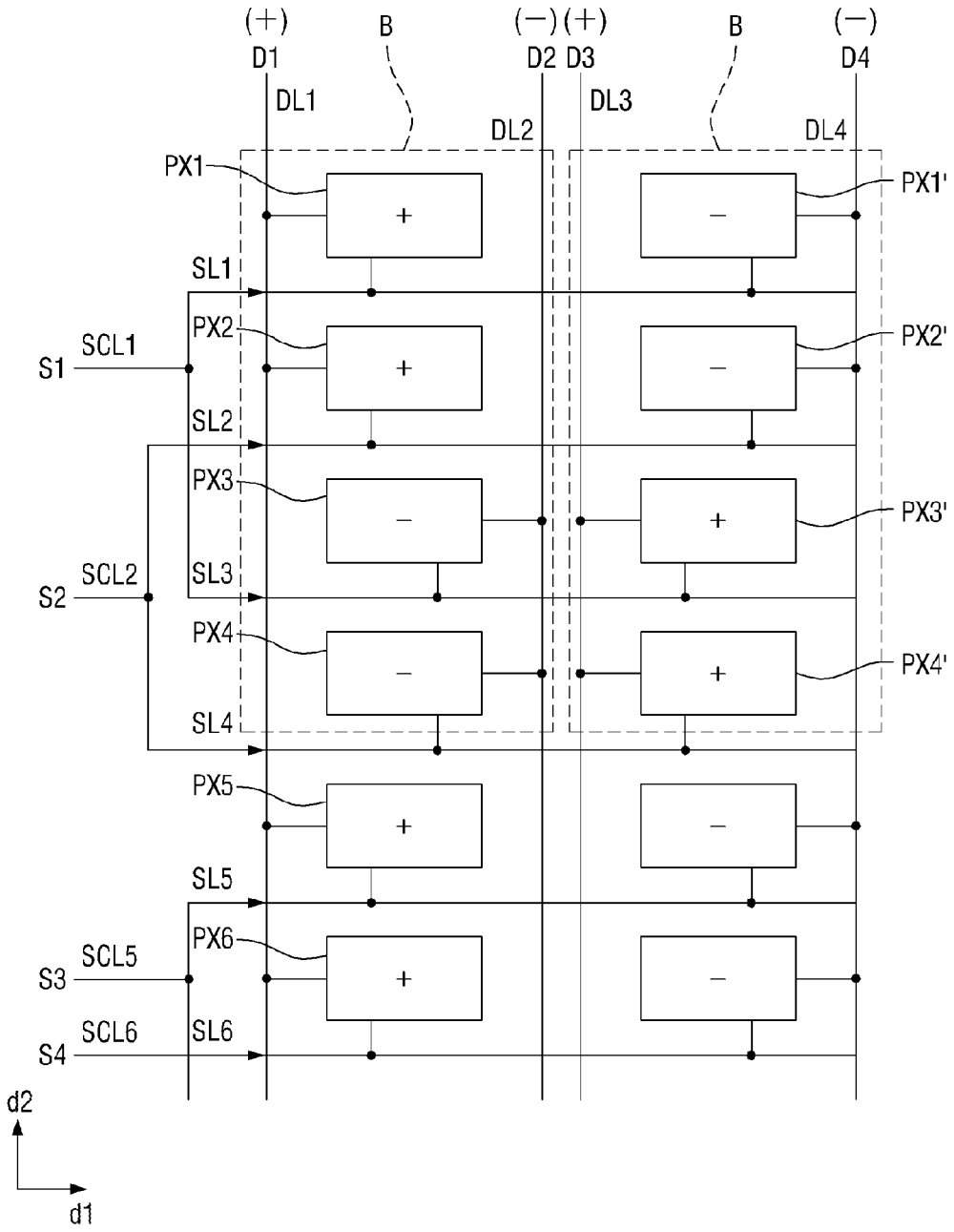
FIGS. 4 and 5 are schematic diagrams illustrating pixels of an exemplary embodiment of the liquid crystal display device and data voltages applied thereto.
Figure 5:
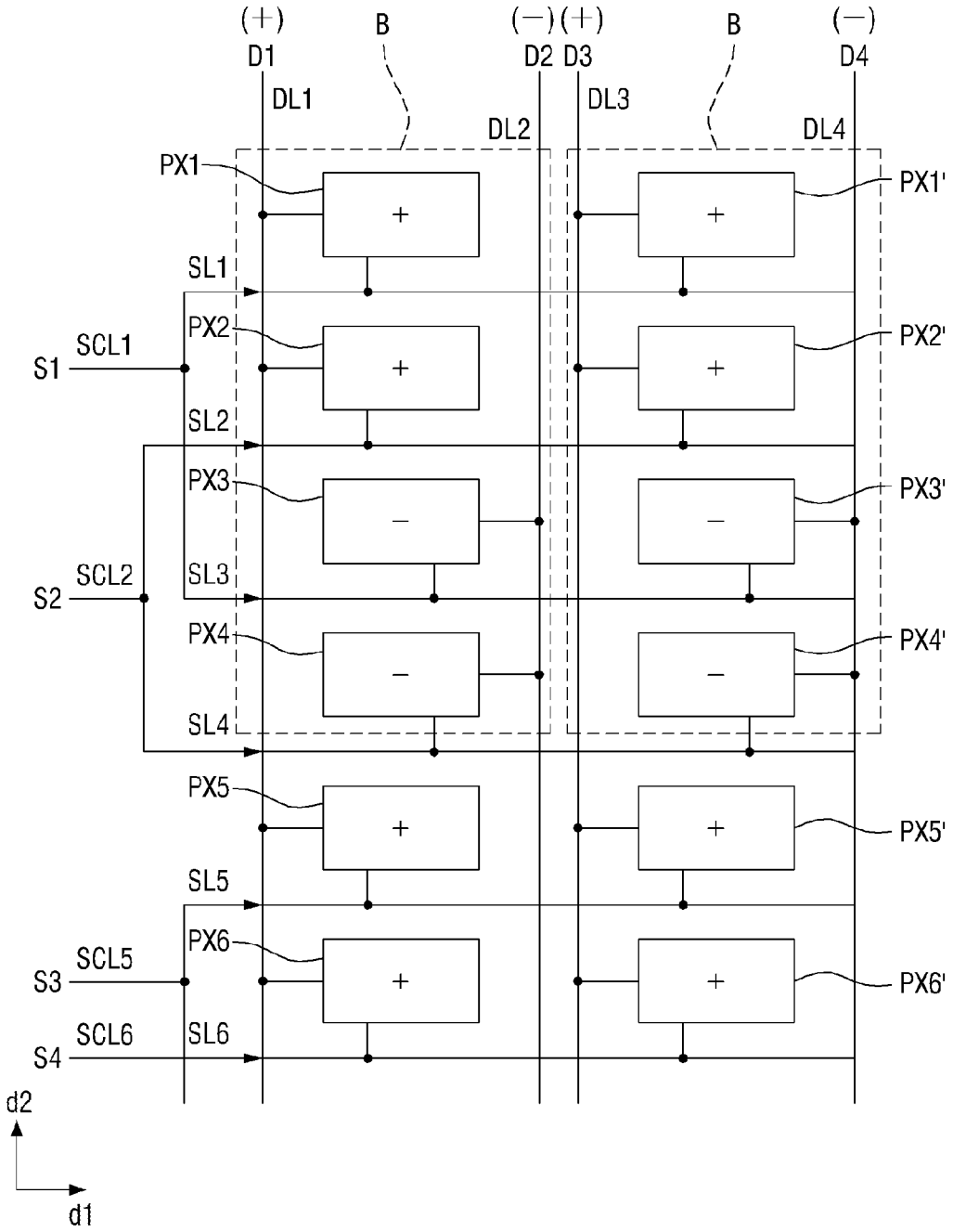
Figure 6:
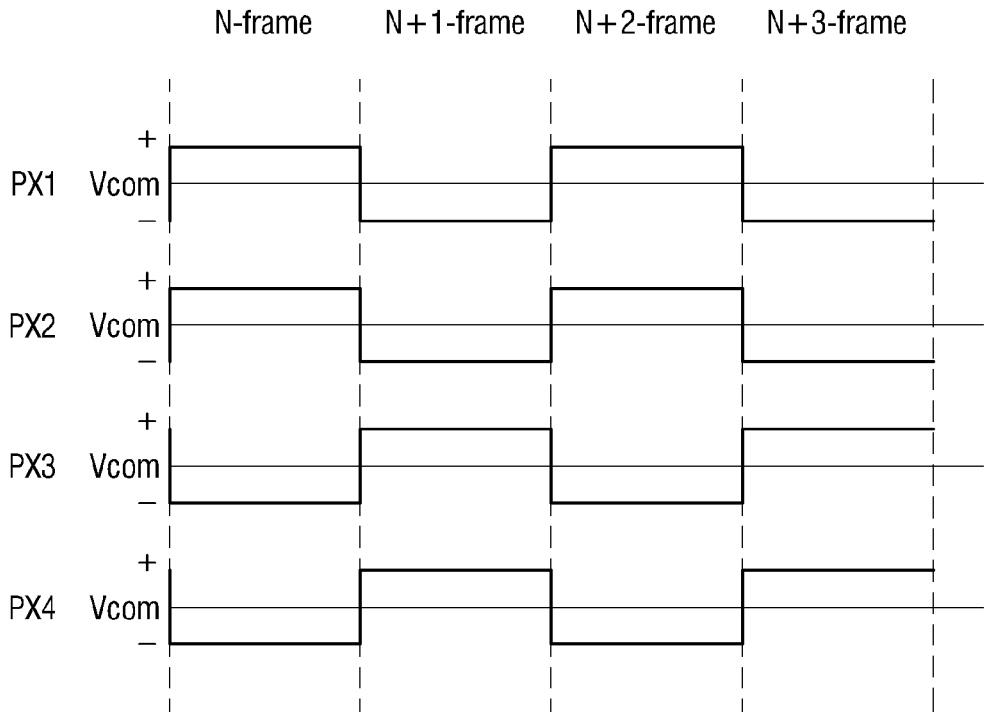
FIG. 6 is a schematic diagram illustrating data voltages applied to pixels of an exemplary embodiment of the liquid crystal display device per frame.

FIG. 2 is an enlarged circuit diagram showing an area A in FIG. 1, and FIG. 3 is a schematic signal timing diagram showing the relationship between a scan signal and a data voltage in an exemplary embodiment of the liquid crystal display device. FIGS. 4 and 5 are schematic diagrams illustrating pixels of an exemplary embodiment of the liquid crystal display device and data voltages applied thereto, and FIG. 6 is a schematic diagram illustrating data voltages applied to pixels of an exemplary embodiment of the liquid crystal display device per frame.

Referring to FIGS. 2 to 6, in an exemplary embodiment, the pixel column block B may include pixels in the form of a 4×1 matrix, in which four pixels PX1, PX2, PX3 and PX4 are arranged in the second direction d2 or the pixel column direction. The first to fourth pixels PX1 to PX4 may correspond to the first to fourth row pixels of the pixel column block B, respectively. However, the matrix arrangement of the pixel column blocks B is not limited thereto.

Referring to FIGS. 2 to 6, each of the pixels PX1, PX2, PX3 and PX4 of the pixel column block B may include a thin film transistor TR, a liquid crystal capacitor Clc, and a hold-up capacitor Cst. The gate terminal of the thin film transistor TR may be connected to a corresponding scan line SL1, SL2, SL3 or SL4. The source terminal of the thin film transistor TR may be connected to a corresponding data line DL1, DL2, DL3 or DL4. In such an embodiment, the drain terminal of the thin film transistor TR may be connected to a node connected to the liquid crystal capacitor Clc and the hold-up capacitor Cst. The thin film transistor TR may be turned on by the scan signal that is applied to the gate terminal thereof, and may transfer the data voltage that is applied to the source terminal to the drain terminal to output the transferred data voltage to the node. The data voltage that is transferred to the node may be transferred to the liquid crystal capacitor Clc and the hold-up capacitor Cst, and the liquid capacitor Clc may change the liquid crystal arrangement based on the data voltage to adjust the transmittance of light that is output from a rear surface thereof. In such an embodiment, the hold-up capacitor Cst may hold the current image as a charged data voltage until the data voltage of the next frame is input.

In an exemplary embodiment, the first scan signal S1 may be simultaneously applied to the first pixel PX1 and the third pixel PX3 of the pixel column block B. In such an embodiment, the first scan line SL1 that is connected to the first pixel PX1 and the third scan line SL3 that is connected to the third pixel PX3 may be connected to a first scan connection line SCL1. The first scan signal S1 may be transferred to the first scan line SL1 and the third scan line SL3 through the first scan connection line SCL1, and the first scan signal S1 may be simultaneously applied to the first pixel PX1 and the third pixel PX3.

The second scan signal S2 may be simultaneously applied to the second pixel PX2 and the fourth pixel PX4 of the pixel column block B. In such an embodiment, the second scan line SL2 that is connected to the second pixel PX1 and the fourth scan line SL4 that is connected to the fourth pixel PX4 may be connected to a second scan connection line SCL2. The second scan signal S2 may be transferred to the second scan line SL2 and the fourth scan line SL4 through the second scan connection line SCL2, and the second scan signal S2 may be simultaneously applied to the second pixel PX2 and the fourth pixel PX4. In such an embodiment, the scan driving unit 120 may be connected to the first scan connection line SCL1 and the second scan connection line SCL2 and may output the scan signals S1 and S2 to the pixel column block B.

According to an exemplary embodiment of the liquid crystal display device, the scan lines are connected in pair, and the scan signal is simultaneously applied to at least two pixels to provide sufficient time for charging to the pixels.

In an exemplary embodiment, the second scan signal S2 may be applied prior to the first scan signal S1. As illustrated in FIG. 3, the plurality of scan signals S1 to Sn may include a scan-on signal Son and a scan-off signal Soff. The thin film transistor Tr of the pixel PX as described above may be turned on by the scan-on signal Son, and may be turned off by the scan-off signal Soff. The data voltage may be charged in the pixel PX in a period that corresponds to the period of the scan-on signal Son. As illustrated in FIG. 3, the second scan signal S2 may have the scan-on signal Son prior to the first scan signal S1, that is, the scan driving unit 130 may output the second scan signal S2 prior to the first scan signal S1. The output order of the scan signal as described above may be applied to the remaining scan lines in the same manner. In such an embodiment, the scan signals S4 and Sn that are applied to the (n+1)-th row pixel and the (n+3)-th row pixel of the pixel column block B, which are repeatedly arranged in the second direction d2, may be output prior to the scan signals S3 and Sn−1 that are applied to the n-th row pixel and the (n+2)-th row pixel of the pixel column block B. The scan order in exemplary embodiments of the liquid crystal display device will be described later in greater detail.

The first pixel PX1 and the second pixel PX2 of the pixel column block B may be connected to the first data line DL1, and the third pixel PX3 and the fourth pixel PX4 may be connected to the second data line DL2. The first data voltage D1 may be applied to the first pixel PX1 and the second pixel PX2 through the first data line DL1, and the second data voltage D2 may be applied to the third pixel PX3 and the fourth pixel PX4 through the second data line DL2. In such an embodiment, the first pixel PX1 and the third pixel PX3 may receive the first data voltage D1 and the second data voltage D2 in response to the first scan signal S1, and the second pixel PX2 and the fourth pixel PX4 may receive the first data voltage D1 and the second data voltage D2 in response to the second scan signal S2.

In an exemplary embodiment, the first data voltage D1 and the second data voltage D2 may have different polarities from each other. The data voltages having different polarities may be applied the pixels in the unit of two pixels of the pixel column block B. In one exemplary embodiment, as illustrated in FIG. 4, the first pixel PX1 and the second pixel PX2, to which the first data voltage D1 is applied, may be charged with positive polarity (+), and the third pixel PX3 and the fourth pixel PX4, to which the second data voltage D2 is applied, may be charged with negative polarity (−). Here, the positive polarity (+) and the negative polarity (−) may be determined based on a common voltage. Accordingly, in such an embodiment, deterioration of the light permeation characteristics of the liquid crystals may be effectively prevented through a column-direction 2-dot inversion driving.

In such an embodiment, different polarities may be applied to the plurality of pixels neighboring in the first direction d1. In one exemplary embodiment, as illustrated in FIG. 4, the first pixel PX1' that neighbors the first pixel PX1 in the first direction d1 may be charged with negative polarity (−) unlike the first pixel PX1, and the second pixel PX2' that neighbors the second pixel PX2 in the first direction d1 may be charged with positive polarity (+) unlike the second pixel PX2. In such an embodiment, the data driving unit 130 may provide the data voltages having different polarities to the neighboring data lines. In such an embodiment, the liquid crystal display device 10 may be inversely driven in a column-direction 1-dot inversion method.

However, the invention is not limited thereto. In an alternative exemplary embodiment, as illustrated in FIG. 5, the data voltages having the same polarity may be applied to the plurality of pixels neighboring in the first direction d1. In such an embodiment, the first pixel PX1' that neighbors the first pixel PX1 in the first direction d1 may be charged with positive polarity (+) like the first pixel PX1, and the second pixel PX2' that neighbors the second pixel PX2 in the first direction d1 may be charged with negative polarity (−) like the second pixel PX2. In such an embodiment, the liquid crystal display device 10 may be inversely driven in a horizontal line inversion method.

In an exemplary embodiment, the data driving unit 130 may apply the data voltages having different polarities to the pixels PX on a frame-by-frame basis. In one exemplary embodiment, for example, the first data voltage D1 and the second data voltage D2 may be inverted by frames. In one exemplary embodiment, as illustrated in FIG. 6, the data voltage having positive polarity (+) may be applied to the first pixel PX1 and the second pixel PX2 in the N-th frame, and the data voltage having negative polarity (−) may be applied to the first pixel PX1 and the second pixel PX2 in the (N+1)-th frame. In such an embodiment, the data voltage having negative polarity (−) may be applied to the third pixel PX3 and the fourth pixel PX4 in the N-th frame, and the data voltage having positive polarity (+) may be applied to the third pixel PX3 and the fourth pixel PX4 in the (N+1)-th frame. Accordingly, in an exemplary embodiment of the liquid crystal display device 10, the deterioration of the light permeation characteristics of the liquid crystal cells may be effectively prevented, and display quality is thereby improved.

Hereinafter, the effects of the above-described scan method, which effectively prevent the data voltage coupling between the neighboring pixels, will be described in greater detail with reference to FIGS. 7 and 8.

Figure 7:
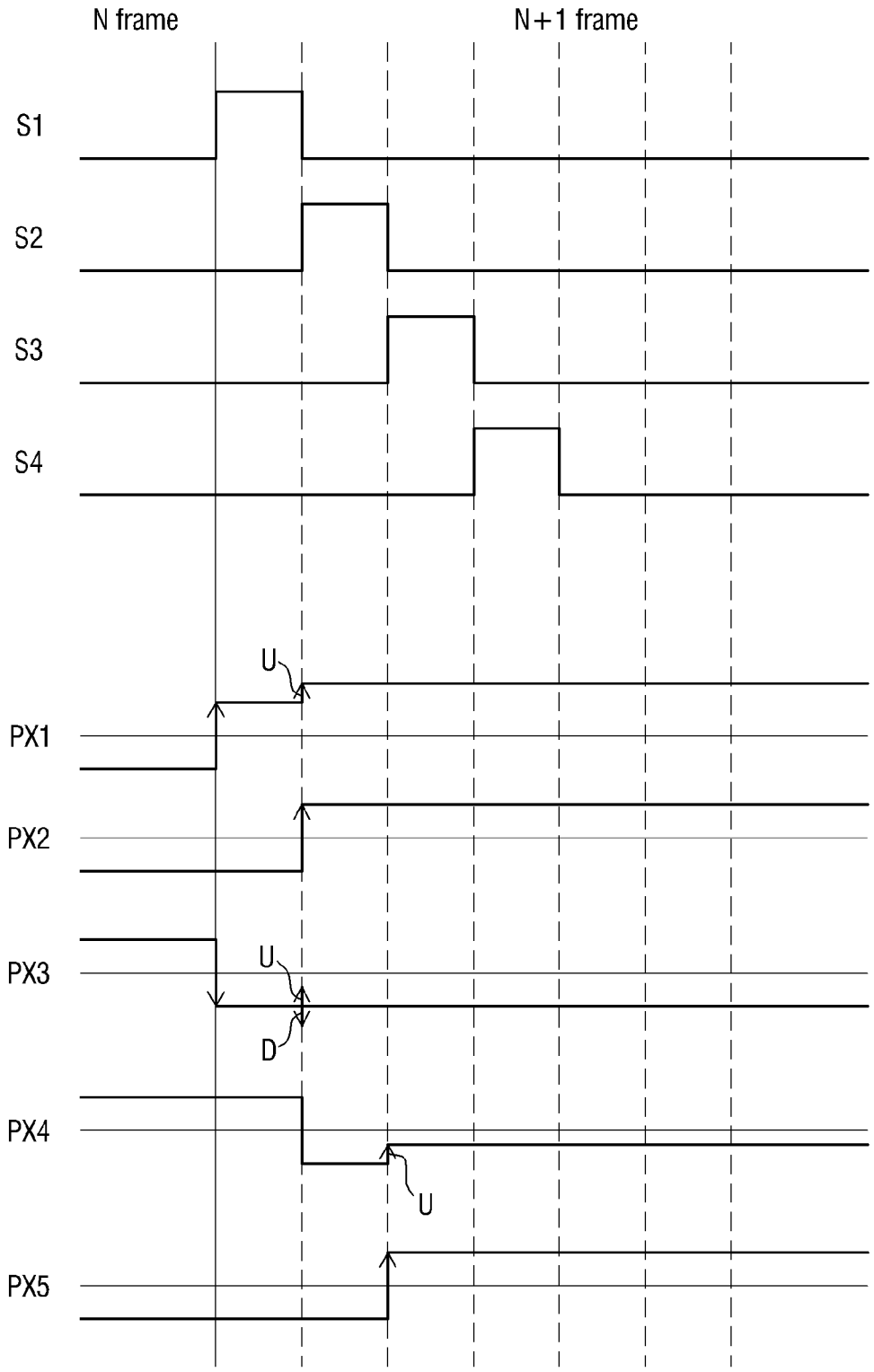
FIGS. 7 and 8 are schematic diagrams illustrating the relationship between a scan order and a data voltage charged to a pixel the liquid crystal display device.
Figure 8:
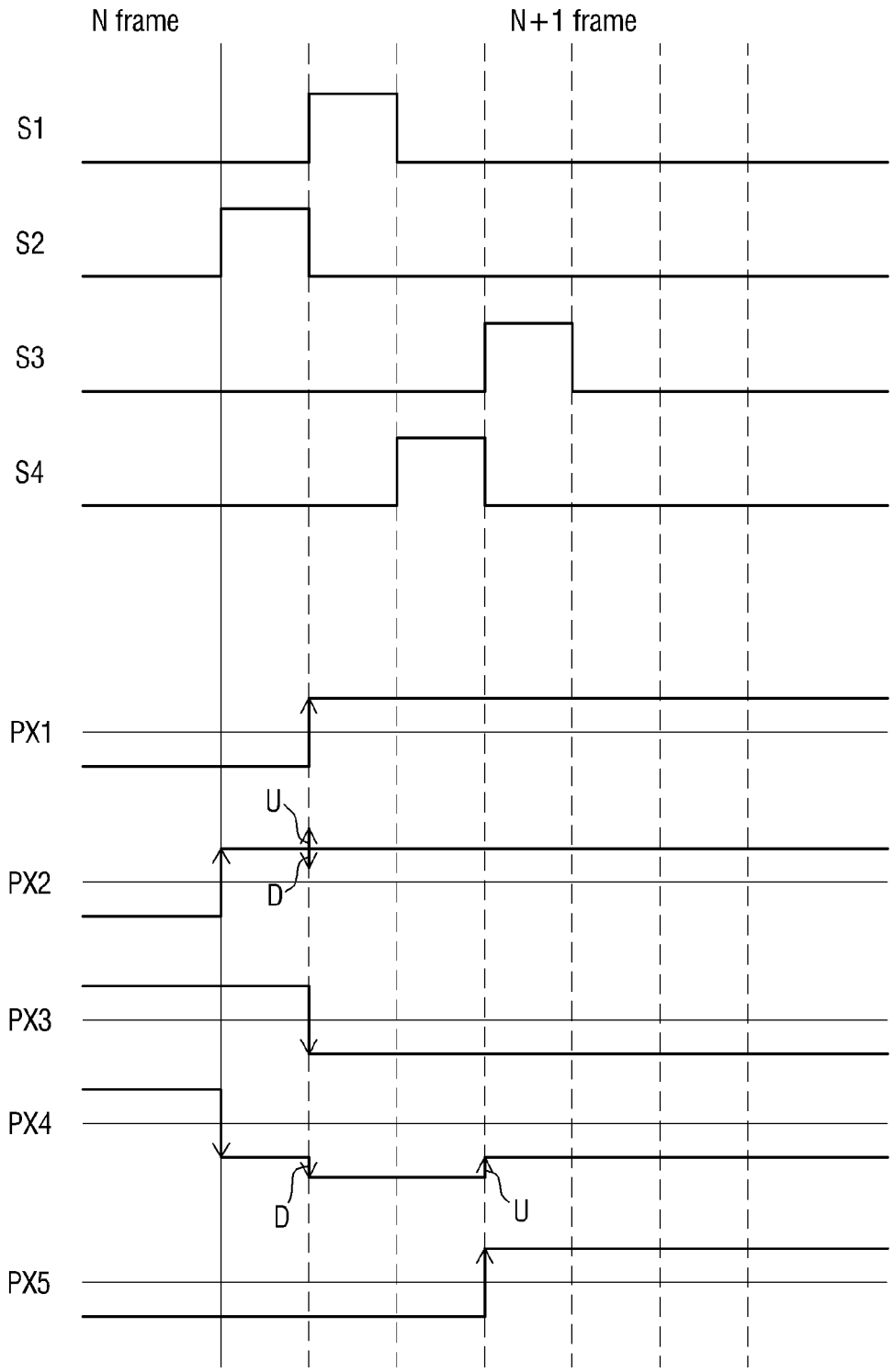

FIGS. 7 and 8 are schematic diagrams illustrating the relationship between a scan order and a data voltage charged to a pixel of the liquid crystal display device.

FIG. 7 is a schematic diagram illustrating the data voltage change of the first to fourth pixels PX1, PX2, PX3 and PX4 of the pixel column block B in an exemplary embodiment, when the plurality of scan signals S1 to Sn are sequentially applied, such that the second scan signal S2 may be applied after the first scan signal S1 is applied. Each of the first to fourth pixels PX1, PX2, PX3 and PX4 may receive data voltages having different polarities on a frame-by-frame basis, e.g., every frame as shown in FIG. 6, and the first and second pixels PX1 and PX2 and the third and fourth pixels PX3 and PX4 may receive data voltages having different polarities from each other. Accordingly, the polarity of the first pixel PX1 and the second pixel PX2 may be changed from negative polarity (−) to positive polarity (+) in response to the scan-on signal of the first scan signal S1, and the polarity of the third pixel PX3 and the fourth pixel PX4 may be changed from positive polarity (+) to negative polarity (−) in response to the second scan signal S2. Here, the data voltage coupling may occur between the neighboring pixels in the column direction. That is, rising-data voltage coupling U may occur in the first pixel PX1 and the third pixel PX3 that neighbor the second pixel PX2 in the column direction by the second pixel PX2 that is charged with the data voltage of positive polarity (+) in response to the second scan signal S2. Accordingly, the data voltage of the first pixel PX1 may become higher than the data voltage that is charged in the second pixel PX2 neighboring the first pixel PX1. Further, falling data voltage coupling D may occur in the third pixel PX3 by the fourth pixel PX4 that is charged with the data voltage of negative polarity (−) in response to the second scan signal S2. However, the data voltage of the third pixel PX3 may not be changed as the rising-data voltage coupling U and the falling-data voltage coupling D offset each other. Further, as the data voltage of positive polarity (+) is charged in the fifth pixel PX, the rising-data voltage coupling U may occur in the fourth pixel PX4, and thus the data voltage of the fourth pixel PX4 may become higher than the third pixel PX3 neighboring the fourth pixel PX4. Through such data coupling, the pixels having the data voltage value that is different from the data voltage value of the neighboring pixels may be visually recognized as a horizontal line on the display unit such that the display quality of the liquid crystal display device may be deteriorated.

FIG. 8 is a schematic diagram illustrating the plurality of scan signals S1 to Sn of an exemplary embodiment of the liquid crystal display device according to the invention, and the data voltage change of the first to fourth pixels PX1, PX2, PX3 and PX4 of the pixel column block B. In an exemplary embodiment, the first scan signal S1 may be applied after the second scan signal S2 is applied. In such an embodiment, each of the first to fourth pixels PX1, PX2, PX3 and PX4 may receive data voltages having different polarities every frame, and the first and second pixels PX1 and PX2 and the third and fourth pixels PX3 and PX4 may receive data voltages having different polarities from each other. Accordingly, the polarity of the first pixel PX1 and the second pixel PX2 may be changed from negative polarity (−) to positive polarity (+) in response to the scan-on signal of the first scan signal S1, and the polarity of the third pixel PX3 and the fourth pixel PX4 may be changed from positive polarity (+) to negative polarity (−) in response to the second scan signal S2. In an exemplary embodiment, the data voltage coupling may occur between the neighboring pixels in the column direction. In such an embodiment, rising-data voltage coupling U may occur in the second pixel PX2 by the first pixel PX1 that is charged with the data voltage of positive polarity (+) in response to the first scan signal S1, and falling-data voltage coupling D may occur in the second pixel PX2 by the third pixel PX3 that is charged with the data voltage of negative polarity (−) in response to the first scan signal S1. The data voltage of the second pixel PX2 may not be changed as the rising-data voltage coupling U and the falling-data voltage coupling D offset each other. In such an embodiment, the falling-data voltage coupling D may occur in the fourth pixel PX4 by the third pixel PX3. However, the data voltage of the fourth pixel PX4 may not be changed as the falling-data voltage coupling D of the fourth pixel PX4 and the rising-data voltage coupling U that occurs as the fifth pixel PX5 is charged with the data voltage of positive polarity (+) offset each other. Accordingly, in such an embodiment, the liquid crystal display device 10 may offset the data coupling occurring in the respective pixels through the method for applying the scan signals as described above, such that the horizontal line is effectively prevented from being visually recognized on the display unit, and thus the display quality is substantially improved.

Hereinafter, an alternative exemplary embodiment of a liquid crystal display device according to the invention will be described with reference to FIGS. 9 to 11. The same or like elements shown in FIGS. 9 to 11 have been labeled with the same reference characters as used above to describe the exemplary embodiments of the liquid crystal display device with reference to FIGS. 1 to 5, and any repetitive detailed description thereof will hereinafter be omitted or simplified.

Figure 9:
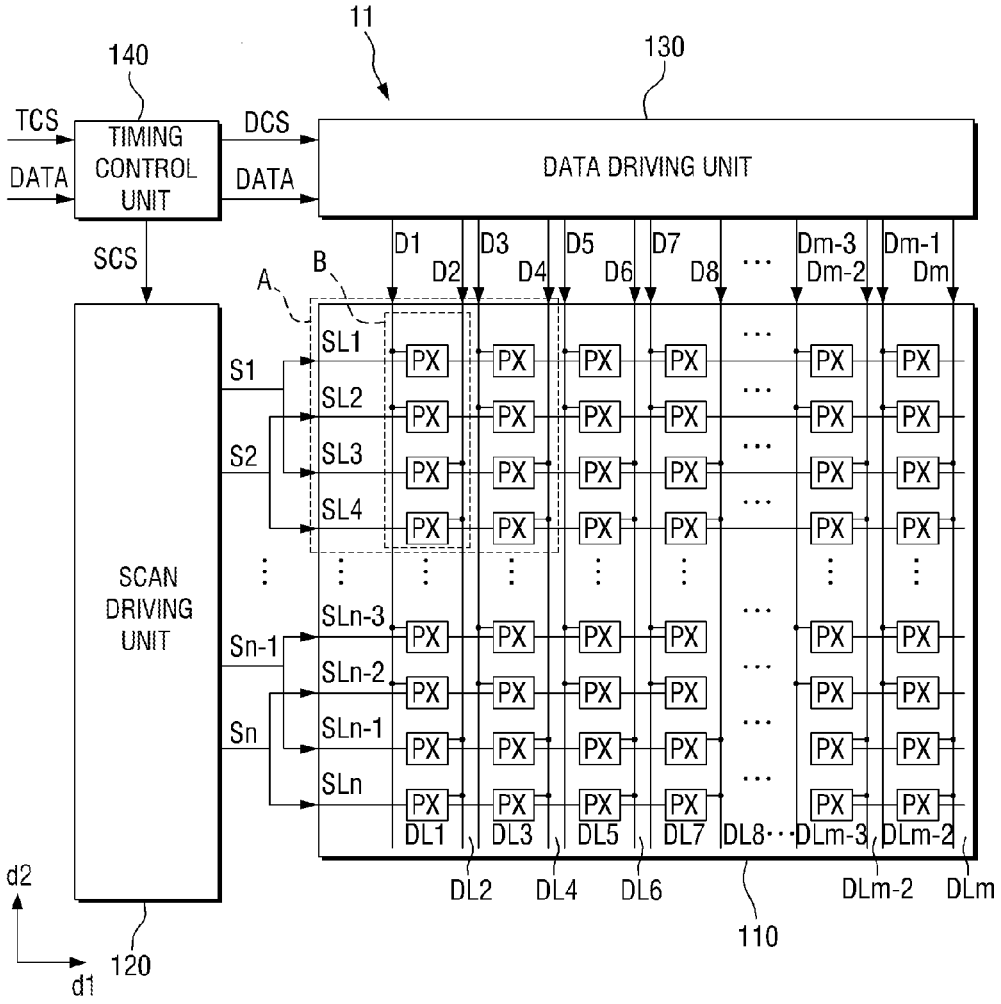
FIG. 9 is a block diagram showing an alternative exemplary embodiment of a liquid crystal display device according to the invention.

FIG. 9 is a block diagram of an alternative exemplary embodiment of a liquid crystal display device according to the invention. FIG. 10 is an enlarged circuit diagram of an area A in FIG. 10, and FIG. 11 is a circuit diagram of pixels in FIG. 10.

Figure 10:
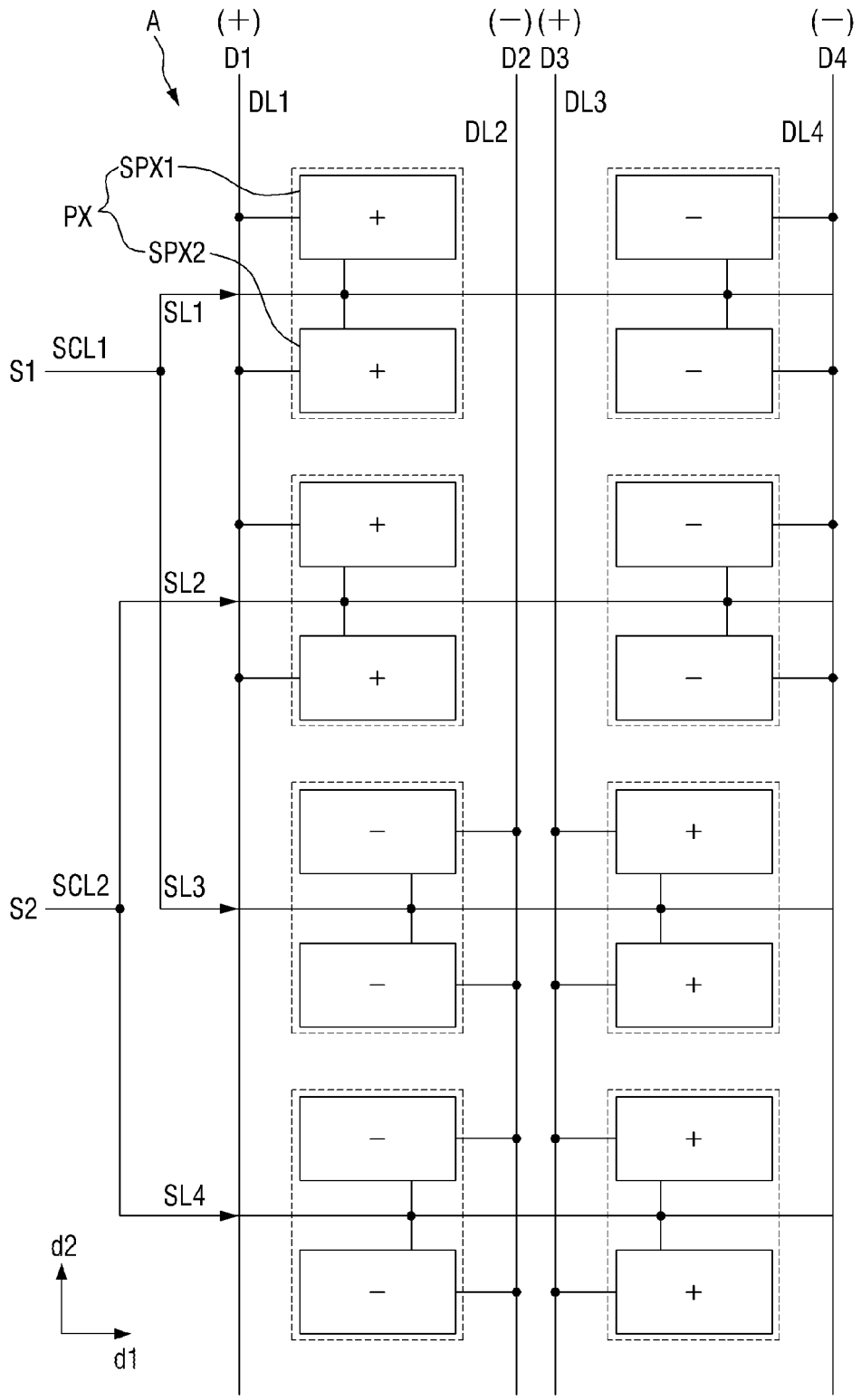
FIG. 10 is an enlarged circuit diagram of an area A in FIG. 10.
Figure 11:
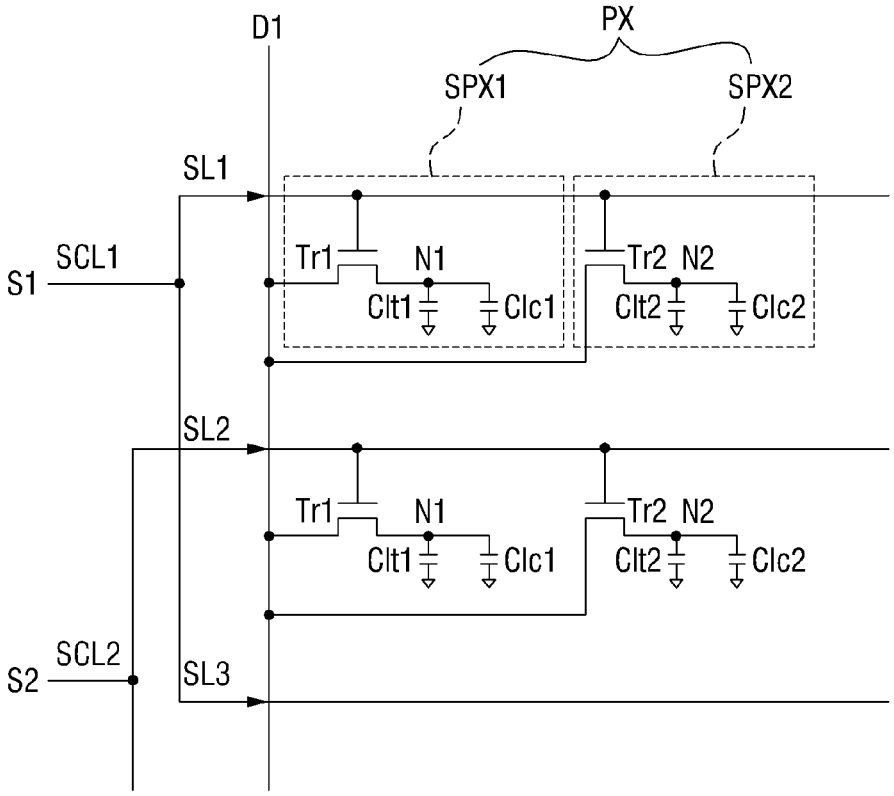
FIG. 11 is a circuit diagram of pixels in FIG. 10.

Referring to FIGS. 9 to 11, an exemplary embodiment of a display unit 110 of a liquid crystal display device may include a plurality of scan lines SL1 to SLn, a plurality of data lines DL1 to DLm that crosses the plurality of scan lines SL1 to SLn, and a plurality of pixels PX connected to the plurality of scan lines SL1 to SLn and the plurality of data lines DL1 to DLm. In such an embodiment, each of the plurality of pixels PX may be connected to a corresponding scan line of the plurality of scan lines SL1 to SLn and a corresponding data line of the plurality of data lines DL1 to DLm. The plurality of scan lines SL1 to SLn may extend substantially in a first direction d1, and may be substantially parallel to each other. The plurality of scan lines SL1 to SLn may include first to n-th scan lines SL1 to SLn that are sequentially arranged. The plurality of data lines DL1 to DLm may cross the plurality of scan lines SL1 to SLn. That is, the plurality of data lines DL1 to DLm may extend substantially in a second direction d2 that is perpendicular to the first direction d1, and may be substantially parallel to each other. Data voltages D1 to Dm may be applied to the plurality of data lines DL1 to DLm. The plurality of pixels PX may be arranged substantially in a matrix form, but are not limited thereto. The plurality of pixels PX may receive the data voltages D1 to Dm that are applied to the data lines DL1 to DLm in response to scan signals S1 to Sn provided from the scan lines SL1 to SLn.

In an exemplary embodiment, the plurality of scan lines SL1 to SLn may passes through the plurality of pixels PX connected thereto. In such an embodiment, as illustrated in FIG. 10, each of the plurality of pixels PX may include a first sub-pixel SPX1 and a second sub-pixel SPX2. The plurality of scan lines SL1 to SLn may cross a region between the first sub-pixel SPX1 and the second sub-pixel SPX2, and may be connected to the first sub-pixel SPX1 and the second sub-pixel SPX2. In such an embodiment, as illustrated in FIG. 11, the first sub-pixel SPX1 may include a first thin film transistor Tr1, a first liquid crystal capacitor Clc1 and a first hold-up capacitor Cst1, and the second sub-pixel SPX2 may include a second thin film transistor Tr2, a second liquid crystal capacitor Clc2 and a second hold-up capacitor Cst2. The first thin film transistor Tr1 may be turned on by the scan signal S1 that is applied to the gate terminal thereof, and may transfer the data voltage D1 that is applied to the source terminal to the drain terminal to output the transferred data voltage to a first node N1. The data voltage D1 may be transferred to the first liquid crystal capacitor Clc1 and the first hold-up capacitor Cst1 through the turned-on first thin film transistor Tr1, and the data voltage may be charged in the first liquid crystal capacitor Clc1 and the first hold-up capacitor Cst.

The second thin film transistor Tr2 may be turned on by the scan signal S1 that is applied to the gate terminal thereof, and may transfer the data voltage D1 that is applied to the source terminal to the drain terminal to output the transferred data voltage to a second node N2. The data voltage D1 may be transferred to the second liquid crystal capacitor Clc2 and the second hold-up capacitor Cst2 through the turned-on second thin film transistor Tr2. In such an embodiment, the first and second subpixels SPX1 and SPX2 receive a same data voltage D1, and the data charge amount that is charged in the first sub-pixel SPX1 based on the data voltage D1 may be different from the data charge amount that is charged in the second sub-pixel SPX2 based on the data voltage D1. In such an embodiment, an area of the first sub-pixel SPX1 may be larger than an area an area of the second sub-pixel SPX2, and the first liquid crystal capacitor Clc1 may be charged with a relatively greater data charge amount than the data charge amount of the second liquid crystal capacitor Clc2. However, the method for charging different data charge amounts in the first sub-pixel SPX1 and the second sub-pixel SPX2 is not limited thereto. In an alternative exemplary embodiment, the liquid crystal display device may further include a separate charge connection line that is connected to only the first sub-pixel SPX1, and additional data voltage may be provided only to the first sub-pixel SPX1 through the charge connection line.

In an alternative exemplary embodiment, the liquid crystal display device may differently adjust the data charge amounts charged in the first sub-pixel SPX1 and the second sub-pixel SPX2, thereby providing improved visual recognition.

Hereinafter, an exemplary embodiment of a method for driving a liquid crystal display device according to the invention will be described with reference to FIG. 12, and FIGS. 1 to 8.

Figure 12:
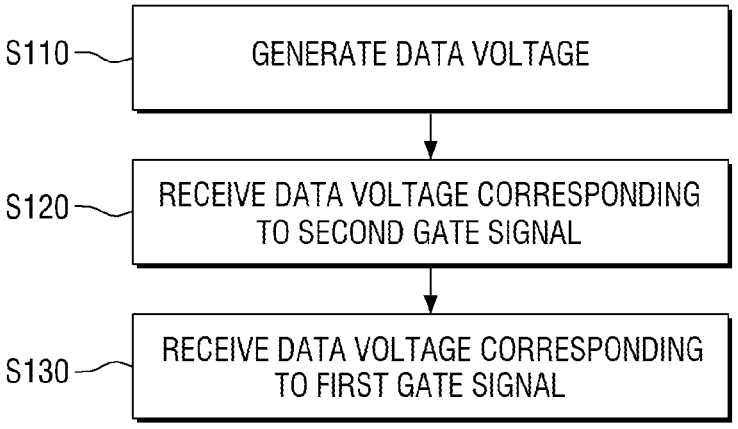
FIG. 12 is a flowchart showing an exemplary embodiment of a method for driving a liquid crystal display device according to the invention.

FIG. 12 is a flowchart showing an exemplary embodiment of a method for driving a liquid crystal display device according to the invention.

In such an embodiment, data voltages are generated (S110).

In an exemplary embodiment, the liquid crystal display may include a display unit 110 that includes a plurality of pixels PX arranged substantially in a matrix form. The display unit 110 may include a plurality of scan lines SL1 to SLn, and a plurality of data lines DL1 to DLm that crosses the plurality of scan lines SL1 to SLn, and each of the plurality of pixels PX may be connected to a corresponding scan line of the plurality of scan lines SL1 to SLn and a corresponding data line of the plurality of data lines DL1 to DLm. Here, the display unit 110 may include a pixel column block B. In such an embodiment, a part of the plurality of pixels PX may define the pixel column block B. The display unit 110 may include a plurality of pixel column blocks B that are repeatedly arranged in the form of a matrix. In such an embodiment, driving methods of the pixel column blocks B are substantially the same as each other. Accordingly, hereinafter, an exemplary embodiment of the driving method of one pixel column block B will be described, for convenience of description.

In an exemplary embodiment, the data driving unit 130 may receive the data control signal DCS and the image data DATA from the timing control unit 140, and may generate data voltages to be provided to the display unit 110. In such an embodiment, the data driving unit 130 may receive a reference voltage generated from the voltage generating unit (not illustrated). The data driving unit 130 may select the reference voltage based on the data control signal DCS, and may convert the digital image data DATA into the plurality of data voltages D1 to Dm in response to the selected reference voltage. The data voltages D1 to Dm may be applied to the plurality of data lines DL1 to DLm, respectively. The first data line DL1 may be connected to the n-th row pixel and the (n+1)-row pixel of the pixel column block B, and the second data line DL2 may be connected to the (n+2)-th row pixel and the (n+3)-th row pixel of the pixel column block B. The first data voltage D1 may be input to the n-th row pixel and the (n+1)-row pixel of the pixel column block B through the first data line DL1, and the second data voltage D2 may be input to the (n+2)-th row pixel and the (n+3)-th row pixel of the pixel column block B through the second data line DL2. The first data voltage D1 and the second data voltage D2 may have different polarities from each other, and the polarities of the first data voltage D1 and the second data voltage D2 may be inverted every frame. In one exemplary embodiment, for example, the first data voltage D1 may be a voltage that is changed from negative polarity (−) to positive polarity (+), and the second data voltage D2 may be a voltage that is changed from positive polarity (+) to negative polarity (−). However, the invention is not limited thereto, and in an alternative exemplary embodiment, the first data voltage D1 and the second data voltage D2 may have the polarities that are opposite to those as described above. In such an embodiment, the method for driving a liquid crystal display device may perform inversion driving based on column-direction 2-dot, or may perform inversion driving on a frame-by-frame basis.

The data voltage corresponding to the second scan signal is received (S120).

The scan driving unit 120 may output a plurality of scan signals S1 to Sn to the display unit 110. In an exemplary embodiment, the first scan signal S1 may be simultaneously applied to the scan line connected to the n-th row pixel and the scan line connected to the (n+2)-th row pixel through the first scan connection line SCL1. In such an embodiment, the second scan signal S2 may be simultaneously applied to the scan line connected to the (n+1)-th row pixel and the scan line connected to the (n+3)-th row pixel through the second scan connection line SCL2. Accordingly, in such an embodiment, the method for driving a liquid crystal display device may simultaneously apply the scan signal to at least two scan lines, thereby providing sufficient time for charging the data voltage to the pixels, as described above. In such an embodiment, the second scan signal S2 may be applied prior to the first scan signal S1, that is, the scan-on signal Son of the first scan signal S1 may be output after the scan-on signal Son of the second scan signal S2 is output. The first data voltage D1 and the second data voltage D2 may be charged in the n-th row pixel and the (n+2)-th row pixel in response to the second scan signal S2.

Then, the data voltage corresponding to the first scan signal is received (S130).

As described above, the first scan signal S1 may be applied after the second scan signal S2 is applied. The n-th row pixel and the (n+2)-th row pixel may be charged with the first data voltage D1 and the second data voltage D2 in response to the first scan signal S1. In such an embodiment, the first data voltage D1 may be a voltage that is changed from negative polarity (−) to positive polarity (+), and the second data voltage D2 may be a voltage that is changed from positive polarity (+) to negative polarity (−). In such an embodiment, the data voltage coupling may occur between the neighboring pixels in the column direction. In such an embodiment, rising-data voltage coupling U may occur in the (n+1)-th row pixel that is previously charged by the n-th row pixel that is charged with the data voltage of positive polarity (+) in response to the first scan signal S1. However, the rising-data voltage coupling U may be offset by the falling data voltage coupling D that is generated by the (n+2)-th row pixel that is charged with the data voltage of negative polarity (−) in response to the first scan signal S1. That is, the charged data voltage level of the (n+1)-th pixel may be lowered by the falling-data voltage coupling D that is generated by the above-described (n+2)-th row pixel.

However, the falling-data voltage coupling D may also be offset by the rising-data voltage coupling U that is generated by the (n+4)-th row pixel, and the (n+3)-th pixel may hold the existing data voltage level. In an exemplary embodiment, the method for driving a liquid crystal display device may offset the data voltage coupling that occurs between the neighboring pixels in the column direction, thereby improving display quality.

An exemplary embodiment of the method for driving a liquid crystal display device shown in FIGS. 9 to 11 is substantially the same as the exemplary embodiment of the method for driving of the liquid crystal display device 10 of FIGS. 1 to 8 described above, and any repetitive detailed description thereof will be omitted.

Although some exemplary embodiments of the invention have been described herein for illustrative purposes, those skilled in the art will appreciate that various modifications, additions and substitutions are possible, without departing from the scope and spirit of the invention as disclosed in the accompanying claims.

What is claimed is:

1. A liquid crystal display device comprising:

a plurality of pixels arranged substantially in a matrix form, wherein a part of the plurality of pixels defines a pixel column block comprising at least four pixel rows, a first scan signal is simultaneously applied to an n-th row pixel and an (n+2)-th row pixel of the pixel column block, a second scan signal, which is applied prior to the first scan signal, is simultaneously applied to an (n+1)-th row pixel and an (n+3)-th row pixel of the pixel column block, a first data voltage is applied to the n-th row pixel and the (n+1)-th row pixel, a second data voltage having a polarity different from a polarity of the first data voltage is applied to the (n+2)-th row pixel and the (n+3)-th row pixel, and the polarities of the first data voltage and the second data voltage are inverted on a frame-by-frame basis.

2. The liquid crystal display device of claim 1, wherein each of the first scan signal and the second scan signal comprises a scan-on signal and a scan-off signal, the n-th row pixel and the (n+2)-th row pixel respectively receive the first data voltage and the second data voltage in response to the scan-on signal of the first scan signal, and the (n+1)-th row pixel and the (n+3)-th row pixel respectively receive the first data voltage and the second data voltage in response to the scan-on signal of the second scan signal.

3. The liquid crystal display device of claim 1, further comprising:

a plurality of scan lines which extends substantially in a first direction and is connected to the plurality of pixels, and a plurality of data lines which extends substantially in a second direction, which is perpendicular to the first direction, and is connected to the plurality of pixels.

4. The liquid crystal display device of claim 3, wherein a scan line connected to the n-th row pixel and a scan line connected to the (n+2)-th row pixel, among the plurality of scan lines, are connected to a first scan connection line to receive the first scan signal, and a scan line connected to the (n+1)-th row pixel and a scan line connected to the (n+3)-th row pixel, among the plurality of scan lines, are connected to a second scan connection line to receive the second scan signal.

5. The liquid crystal display device of claim 1, wherein each of the plurality of pixels comprises a first sub-pixel and a second sub-pixel, and the plurality of scan lines crosses a region between the first sub-pixel and the second sub-pixel in the first direction.

6. The liquid crystal display device of claim 5, wherein the first sub-pixel and the second sub-pixel have different data charge amounts from each other with respect to a same data voltage.

7. The liquid crystal display device of claim 1, wherein the pixel column block is defined by pixels in a 4×1 matrix form among the plurality of pixels, the first scan signal is simultaneously applied to a first row pixel and a third row pixel of the pixel column block, the second scan signal is simultaneously applied to a second row pixel and a fourth row pixel of the pixel column block, the first data voltage is applied to the first row pixel and the second row pixel of the pixel column block, and the second data voltage is applied to the third row pixel and the fourth row pixel of the pixel column block.

8. The liquid crystal display device of claim 1, wherein data voltages having different polarities from each other are applied to neighboring pixels in a row direction.

9. The liquid crystal display device of claim 1, wherein data voltages having a same polarity as each other are applied to neighboring pixels in a row direction.

10. A liquid crystal display device comprising:

a display unit comprising a plurality of pixels arranged substantially in a matrix form, wherein a pixel column block comprising at least four pixel rows is defined by a part of the plurality of pixels;

a scan driving unit which simultaneously applies a first scan signal to an n-th row pixel and an (n+2)-th row pixel of the pixel column block, and simultaneously applies a second scan signal to an (n+1)-th row pixel and an (n+3)-th row pixel of the pixel column block; and a data driving unit which applies a first data voltage to the n-th row pixel and the (n+1)-th row pixel and applies a second data voltage having a polarity different from a polarity of the first data voltage to the (n+2)-th row pixel and the (n+3)-th row pixel, wherein the scan driving unit applies the first scan signal after applying the second scan signal, and the polarities of the first data voltage and the second data voltage are inverted on a frame-by-frame basis.

11. The liquid crystal display device of claim 10, wherein each of the first scan signal and the second scan signal comprises a scan-on signal and a scan-off signal, the n-th row pixel and the (n+2)-th row pixel respectively receive the first data voltage and the second data voltage in response to the scan-on signal of the first scan signal, and the (n+1)-th row pixel and the (n+3)-th row pixel respectively receive the first data voltage and the second data voltage in response to the scan-on signal of the second scan signal.

12. The liquid crystal display device of claim 10, wherein the display unit further comprises:

a plurality of scan lines which extends substantially in a first direction and is connected to the plurality of pixels; and a plurality of data lines which extends in substantially a second direction, which is perpendicular to the first direction, and is connected to the plurality of pixels.

13. The liquid crystal display device of claim 12, wherein the scan driving unit applies the first scan signal and the second scan signal to a first scan connection line and a second scan connection line, respectively, the first scan connection line is connected to a scan line connected to the n-th row pixel and a scan line connected to the (n+2)-th row pixel among the plurality of scan lines, and the second scan connection line is connected to a scan line connected to the (n+1)-th row pixel and a scan line connected to the (n+3)-th row pixel among the plurality of scan lines.

14. The liquid crystal display device of claim 10, wherein the pixel column block is defined by pixels in a 4×1 matrix form among the plurality of pixels, the first scan signal is simultaneously applied to a first row pixel and a third row pixel of the pixel column block, the second scan signal is simultaneously applied to a second row pixel and a fourth row pixel of the pixel column block, the first data voltage is applied to the first row pixel and the second row pixel of the pixel column block, and the second data voltage is applied to the third row pixel and the fourth row pixel of the pixel column block.

15. The liquid crystal display device of claim 10, wherein data voltages having different polarities from each other are applied to neighboring pixels in a row direction.

16. The liquid crystal display device of claim 10, wherein data voltages having a same polarity as each other are applied to neighboring pixels in a row direction.

17. A method for driving a liquid crystal display device, the method comprising:

generating a first data voltage and a second data voltage having different polarities from each other;

applying the first data voltage and the second data voltage to an n-th row pixel and an (n+2)-th row pixel of a pixel column block defined in a plurality of pixels of the liquid crystal display device, wherein the plurality of pixels are arranged substantially in a matrix form and the pixel column block comprises at least four pixel rows; and applying the first data voltage and the second data voltage to an (n+1)-th row pixel and an (n+3)-th row pixel of the pixel column block wherein a first scan signal is simultaneously applied to the n-th pixel and the (n+2)-th pixel, a second scan signal, which is applied prior to the first scan signal, is simultaneously applied to the (n+1)-th row pixel and the (n+3)-th row pixel, and the polarities of the first data voltage and the second data voltage are inverted on a frame-by-frame basis.

18. The method of claim 17, wherein each of the first scan signal and the second scan signal comprises a scan-on signal and a scan-off signal, the n-th row pixel and the (n+2)-th row pixel respectively receive the first data voltage and the second data voltage in response to the scan-on signal of the first scan signal, and the (n+1)-th row pixel and the (n+3)-th row pixel respectively receive the first data voltage and the second data voltage in response to the scan-on signal of the second scan signal.

19. The method of claim 17, wherein data voltages having different polarities from each other are applied to neighboring pixels in a row direction.

20. The method of claim 17, wherein data voltages having a same polarity as each other are applied to neighboring pixels in a row direction.

21. A liquid crystal display device comprising:

a plurality of pixels arranged substantially in a matrix form having a plurality of pixel rows and a plurality of pixel columns, wherein four consecutive pixels in each pixel row defines a pixel column block, which is repeatedly arranged therein, a first scan signal is simultaneously applied to a first row pixel and a third row pixel of the pixel column block, a second scan signal, which is applied prior to the first scan signal, is simultaneously applied to a second row pixel and a fourth row pixel of the pixel column block, a first data voltage is applied to the first row pixel and the second row pixel, a second data voltage having a polarity different from a polarity of the first data voltage is applied to the third row pixel and the fourth row pixel, and the polarities of the first data voltage and the second data voltage are inverted on a frame-by-frame basis.

22. The liquid crystal display device of claim 21, wherein a plurality of scan lines which extends substantially in a first direction and is connected to the plurality of pixels, a plurality of data lines which extends substantially in a second direction, which is perpendicular to the first direction, and is connected to the plurality of pixels, and a scan line connected to the first row pixel and a scan line connected to the third row pixel, among the plurality of scan lines, are connected to a first scan connection line to receive the first scan signal, and a scan line connected to the second row pixel and a scan line connected to the fourth row pixel, among the plurality of scan lines, are connected to a second scan connection line to receive the second scan signal.

23. The liquid crystal display device of claim 21, wherein each of the plurality of pixels comprises a first sub-pixel and a second sub-pixel, and the first sub-pixel and the second sub-pixel have different data charge amounts from each other with respect to a same data voltage.

24. The liquid crystal display device of claim 21, wherein data voltages having different polarities from each other are applied to neighboring pixels in a row direction.

25. The liquid crystal display device of claim 21, wherein data voltages having a same polarity as each other are applied to neighboring pixels in a row direction.

* * * * *